US011247259B2

(12) United States Patent
Flood et al.

(10) Patent No.: US 11,247,259 B2
(45) Date of Patent: Feb. 15, 2022

(54) FORMING ROLLER ADJUSTMENT SYSTEM

(71) Applicant: Knudson Mfg., Inc., Broomfield, CO (US)

(72) Inventors: Patrick Flood, Arvada, CO (US); Robert L. Eck, III, Arvada, CO (US)

( * ) Notice: Subject to any disclaimer, the term of this patent is extended or adjusted under 35 U.S.C. 154(b) by 0 days.

(21) Appl. No.: 17/034,760

(22) Filed: Sep. 28, 2020

(65) Prior Publication Data

US 2021/0129204 A1 May 6, 2021

Related U.S. Application Data

(60) Provisional application No. 62/930,991, filed on Nov. 5, 2019.

(51) Int. Cl.
*B21D 37/04* (2006.01)
*B21D 5/08* (2006.01)

(52) U.S. Cl.
CPC ..... *B21D 37/04* (2013.01); *B21D 5/08* (2013.01)

(58) Field of Classification Search
CPC ..... B21B 31/16; B21B 31/22; B21B 27/021; B21B 27/028; B21B 27/03; B21B 27/032; B21D 5/08; B21D 5/083; B21D 37/04
USPC ..... 492/1
See application file for complete search history.

(56) References Cited

U.S. PATENT DOCUMENTS

| | | | | |
|---|---|---|---|---|
| 3,529,461 | A | 9/1970 | Knudson | |
| 3,791,185 | A | 2/1974 | Knudson | |
| 4,557,358 | A * | 12/1985 | Petrak | B60K 17/3515 180/233 |
| 4,580,492 | A * | 4/1986 | Troyan | B41F 17/00 101/28 |
| 4,811,587 | A | 3/1989 | Knudson | |
| 4,899,566 | A | 2/1990 | Knudson | |
| 5,038,592 | A | 8/1991 | Knudson | |
| 5,551,272 | A | 9/1996 | Knudson | |
| 5,787,748 | A | 8/1998 | Knudson et al. | |
| 6,604,886 | B2 * | 8/2003 | Kinzler | B62K 21/18 384/57 |
| 6,931,903 | B2 | 8/2005 | Knudson et al. | |
| 8,516,732 | B2 * | 8/2013 | Burnsed, Jr. | F41C 33/002 42/85 |

* cited by examiner

*Primary Examiner* — Adam J Eiseman
*Assistant Examiner* — Fred C Hammers
(74) *Attorney, Agent, or Firm* — Ancel W. Lewis, Jr.; John R. Hayden; Cochran Freund & Young LLC

(57) ABSTRACT

A forming roller adjustment system has a shaft, a key, a roller and a ring. The key fits into a keyway in the shaft and has a projecting portion that projects outwardly from the shaft. The projecting portion includes spaced, transverse channels. The ring is rotatably attached to the roller. The roller and ring each have a shaft aperture that receives the shaft, and a keyway that receives the projecting portion of the key. The ring fits into the channels in the projecting portion of the key. When the keyways on the ring and roller are aligned, the roller is movable along the shaft. When the ring is aligned with one of the channels in the projecting portion of the key and rotated into the channel, the roller is axially locked on the shaft.

7 Claims, 3 Drawing Sheets

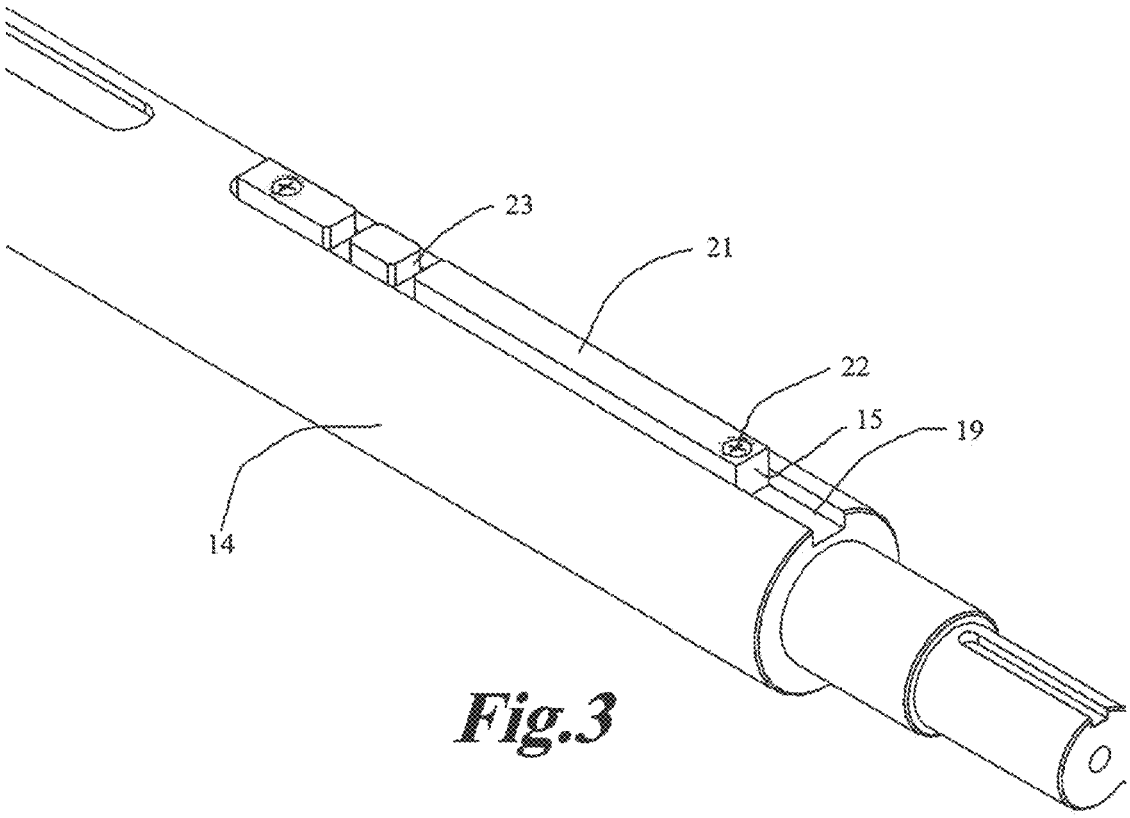
Fig.3
Fig.4
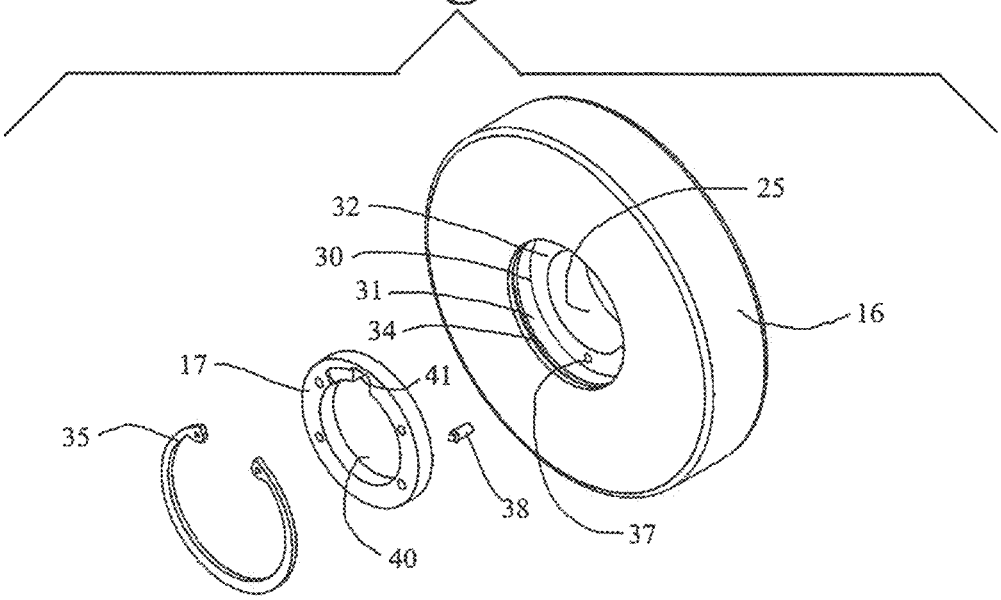

FORMING ROLLER ADJUSTMENT SYSTEM

TECHNICAL FIELD

The present invention relates to sheet metal roll forming machinery, and more particularly to a forming roller adjustment system.

BACKGROUND ART

Sheet metal roll forming machines generally have a number of longitudinally spaced forming stations that progressively bend a flat strip of sheet metal into the selected shape. Each station includes a least one pair of forming rollers. Each roller in a pair is mounted on a separate shaft and the sheet metal passes between the rollers in the pair. The shafts of the rollers in the pair are driven in opposite directions to draw or feed the material through the machine.

Some prior known sheet metal roll forming machines were built to produce a single shape with a single width. Sheet metal roll forming machines that can produce more than one width of, for example, a metal building panel or rain gutter, are more versatile. There are several prior known systems for lateral adjustment of rollers to accommodate forming different widths of products.

One such system involves using keyways and keys to transmit torque from the shaft to the roller, and sleeves or spacers of specific lengths mounted on the shafts for positioning. In this case, repositioning of the rollers for different profiles requires the rearrangement of the spacers to achieve new positions along the shafts for the rollers. Changing width with this system is highly time consuming and demands extensive handling of either tools and/or parts.

Another system uses keyways and keys for torque, and mechanical connection of the roller to a side support structure for positioning. In this case, the side structures which support and position the shafts are mechanically positioned or repositioned to form different profile widths. This type of system is complex and expensive.

A third system includes a precision fastener threaded through a pre-drilled hole in the roller and into a specifically positioned hole in the shaft. The precision fastener provides for both the torque and positioning functions. Changing width with this system is also highly time consuming and demands extensive handling of either tools and/or parts.

U.S. Pat. No. 4,811,587 to Knudson discloses a laterally adjustable side carrier for making panels of different widths. U.S. Pat. No. 4,899,566 to Knudson discloses a first group of stations that are adjustable to different width settings using the same rollers to form more than one width of ogee type gutter. U.S. Pat. No. 5,038,592 to Knudson discloses apparatus for making different residential and commercial building siding of different widths includes a series of roller stations with selective vertical roller positioning adjustments and selective axial lateral roller portion position adjustments. U.S. Pat. No. 5,787,748 to Knudson and Flood discloses variable panel forming apparatus with drive stations having upper and lower rollers each independently adjustable to accommodate different panel widths.

DISCLOSURE OF THE INVENTION

A forming roller adjustment system includes a shaft, a key, a roller and a ring. The shaft has an axially extending shaft keyway. The key is sized to fit into the keyway and has a projecting portion that projects outwardly from the shaft. The projecting portion includes a plurality of spaced, transverse channels. The roller has a roller shaft aperture sized to receive the shaft, and a roller keyway that projects outwardly from the roller shaft aperture and is sized to receive the projecting portion of the key. The ring has a ring shaft aperture sized to receive the shaft, and a ring keyway that projects outwardly from the ring shaft aperture and is sized to receive the projecting portion of the key. The ring is rotatably attached to the roller and sized to fit into the channels in the projecting portion of the key. When the ring is rotated to align the ring keyway with the roller keyway, the roller is axially movable along the shaft. When the ring is aligned with one of the channels in the projecting portion of the key and rotated into the channel such that the ring keyway is not aligned with the roller keyway, the roller is axially locked on the shaft.

BRIEF DESCRIPTION OF THE DRAWINGS

Details of this invention are described in connection with the accompanying drawings that bear similar reference numerals in which:

FIG. 3 is a perspective view of the shaft and the key of the system of FIG. 1.

FIG. 4 is an exploded perspective view of the roller and the ring of the system of FIG. 1.

DETAILED DESCRIPTION OF THE INVENTION

Figure 1:
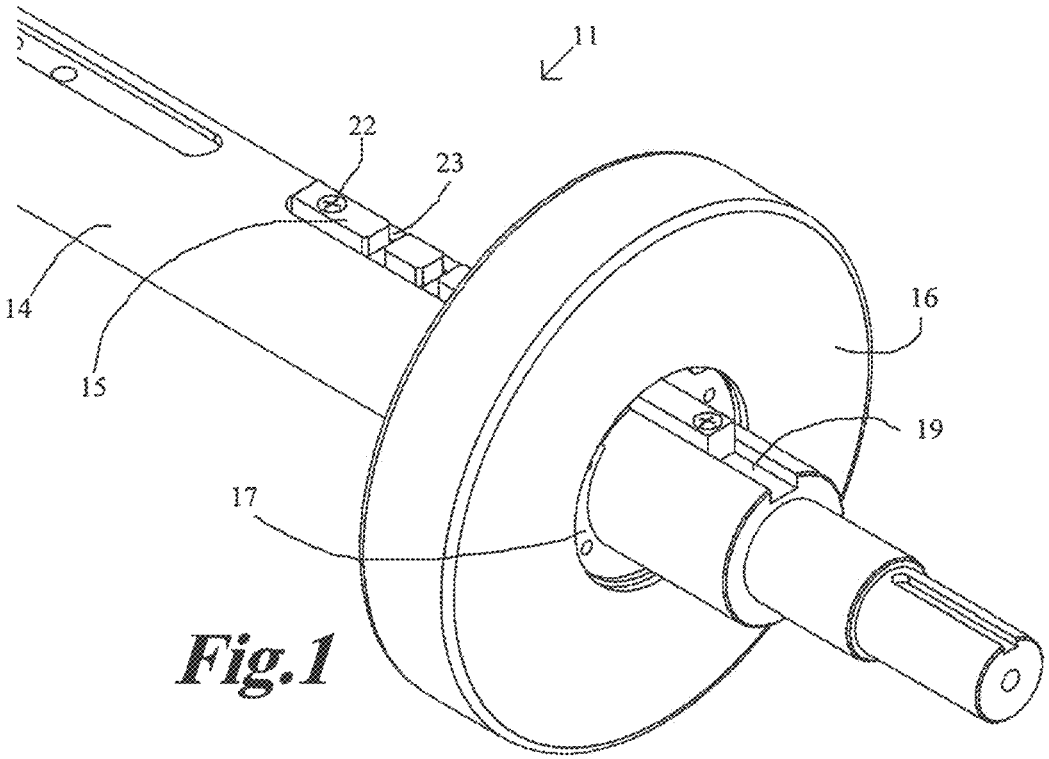
FIG. 1 is a perspective view of a forming roller adjustment system embodying features of the present invention, with the roller axially movable on the shaft.
Figure 2:
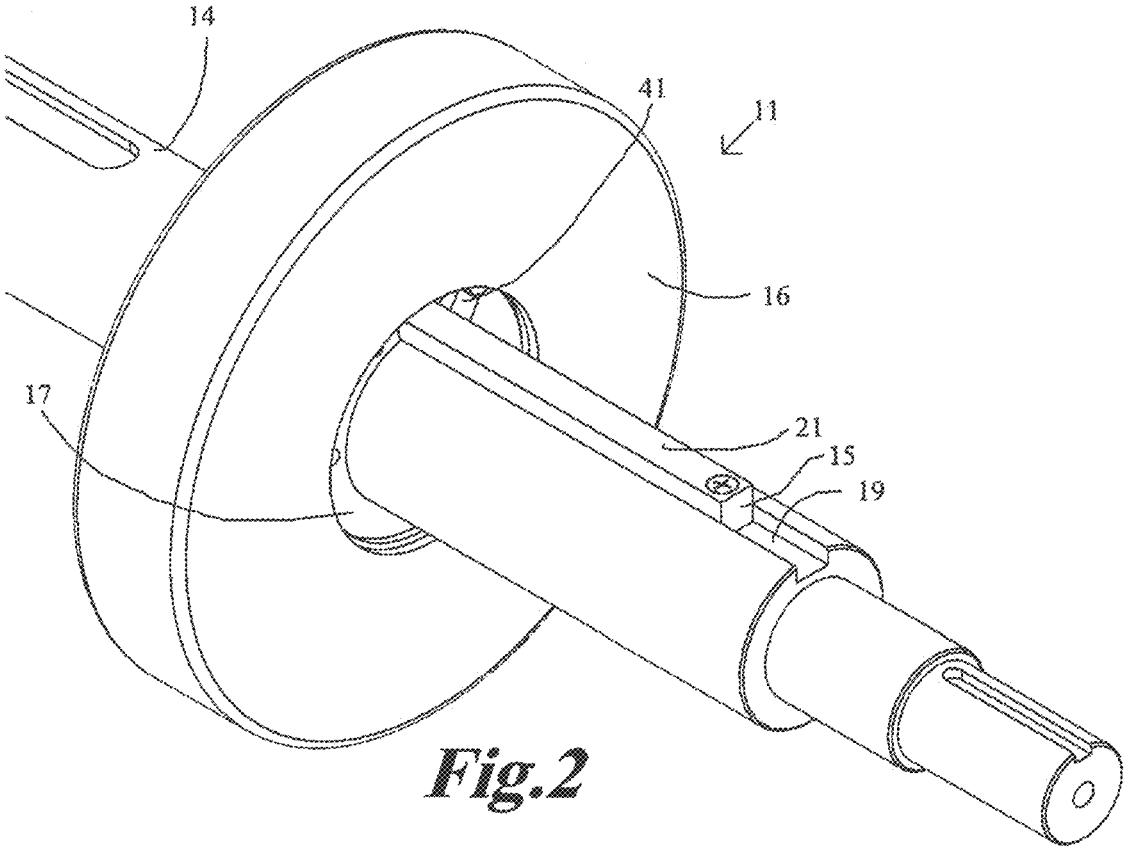
FIG. 2 is a perspective view of the system of FIG. 1, with the roller axially locked on the shaft.

Referring to FIGS. 1 and 2, a forming roller adjustment system 11, for a roll forming machine, embodying features of the present invention, includes a shaft 14, a key 15, a roller 16 and a ring 17. As shown in FIG. 3, the shaft 14 is generally an elongated cylinder and has an axially extending shaft keyway 19. The shaft keyway 19 is a channel with a rectangular cross section that extends radially inwardly from the surface of the shaft 14.

The key 15 has a rectangular cross section, and is sized and shaped to fit into the shaft keyway 19 with a projecting portion 21 that projects radially outwardly beyond the shaft 14. The key 15 is attached to the shaft 14 by mechanical fasteners 22. A plurality of axially spaced channels 23 extend transversely through the projecting portion 21 of the key 15.

Referring to FIGS. 3 to 7, the roller 16 has a roller shaft aperture 25 sized to receive the shaft 14, and a roller keyway 26 that extends radially outwardly from the roller shaft aperture 25 and is sized to receive the projecting portion 21 of the key 15. The roller 16 shown is cylindrical with a first face 28 and a spaced, oppositely facing second face 29. The roller 16 may be of any shape or configuration that can be used for roll forming. The roller 16 includes a cylindrical ring recess 30 defined by a cylindrical face 31 that extends inwardly from the first face 28 connected to a radial face 32 that extends radially outwardly from the roller shaft aperture 25 to beyond the roller keyway 26.

A radially outwardly extending circlip groove 34 extends circumferentially around cylindrical face 31 near the first face 28, and the roller 16 includes a circlip 35 that fits into the circlip groove 34. The roller 16 has a detent aperture 37 that extends through the roller from the radial face 32 and a ball detent 38 that fits into the detent aperture 37 from the radial face 32. The ball detent 38 shown is opposite the roller keyway 26.

The ring 17 is generally cylindrical and rotatably mounted to the roller 16. The ring 17 is sized to fit into the ring recess 30 between the radial face 32 and the circlip 35. The ring 17 has a ring shaft aperture 40 sized to receive the shaft 14, and a ring keyway 41 that extends radially outwardly from the ring shaft aperture 40 and is sized to receive the projecting portion 21 of the key 15.

Figure 7:
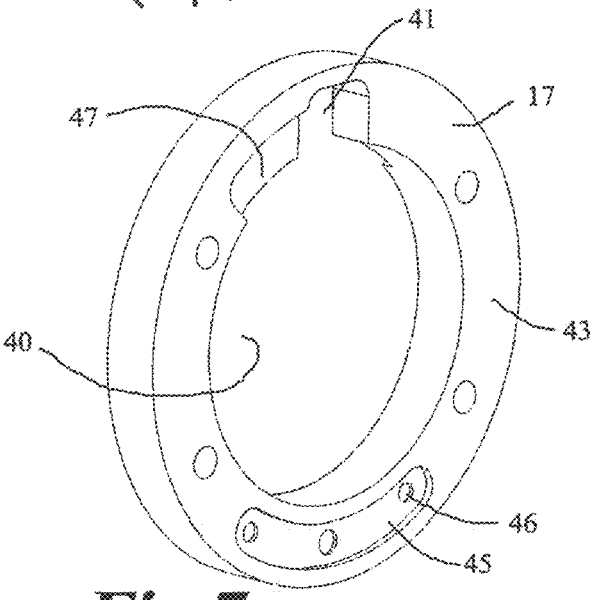
FIG. 7 is an inner perspective view of the ring of the system of FIG. 1.

The ring 17 has an inner face 43, that faces the radial face 32 of the ring recess 30, and a spaced outer face 44, the faces the circlip 35. The inner face 43, as shown in FIG. 7, includes a circumferentially extending recessed portion 45 opposite the ring keyway 41. The recessed portion 45 has three circumferentially spaced detents 46. The detents 46 are sized and positioned to receive the ball detent 38 to hold the ring 17 relative to the roller 16 with the ring keyway 41 aligned with the roller keyway 26, with the ring keyway 41 moved counter-clockwise relative to the roller keyway 26 or with the ring keyway 41 moved clockwise relative to the roller keyway 26.

The ring 17 is sized to fit into channels 23 in the projecting portion 21 of the key 15. To adjust the roller 16 on the shaft 14, the ring 17 is rotated to align the ring keyway 41 with the roller keyway 26, as shown in FIG. 1. When the ring keyway 41 is aligned with the roller keyway 26, the roller 16 is axially movable on the shaft 14. The roller 16 is moved to align the ring 17 with the selected channel 23 through the projecting portion 21 of the key 15, and the ring 17 is rotated into the selected channel 23 to axially lock the roller 16 on the shaft 14, as shown in FIG. 2.

Figure 5:
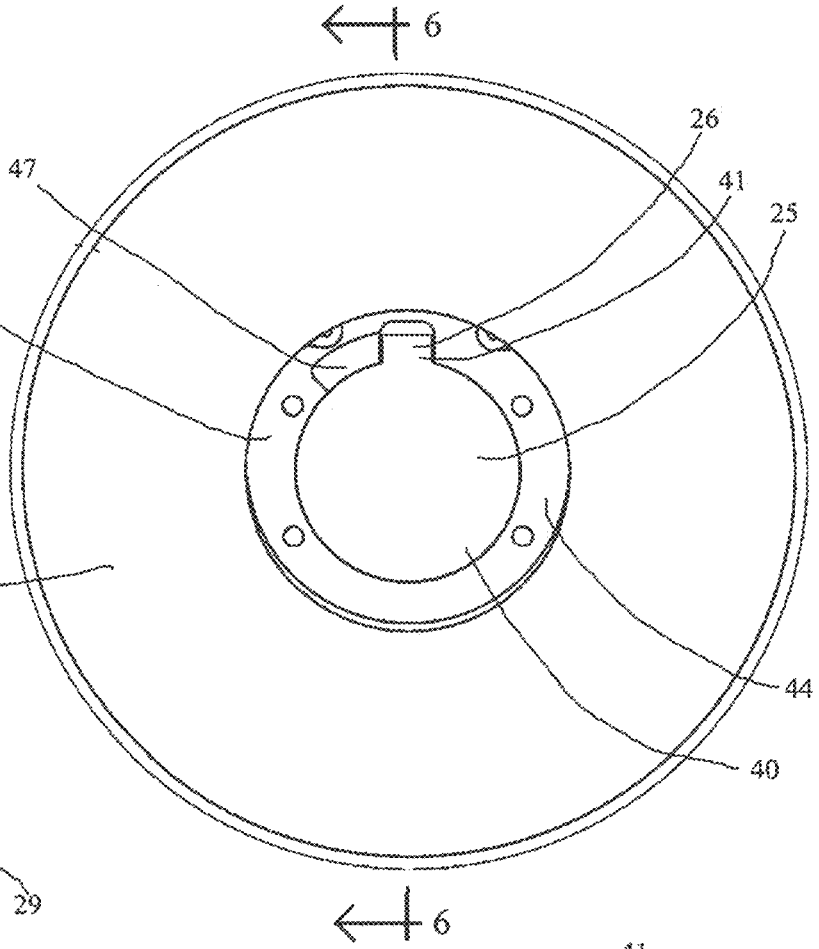
FIG. 5 is a side elevation view of the roller and the ring of the system of FIG. 1.
Figure 6:
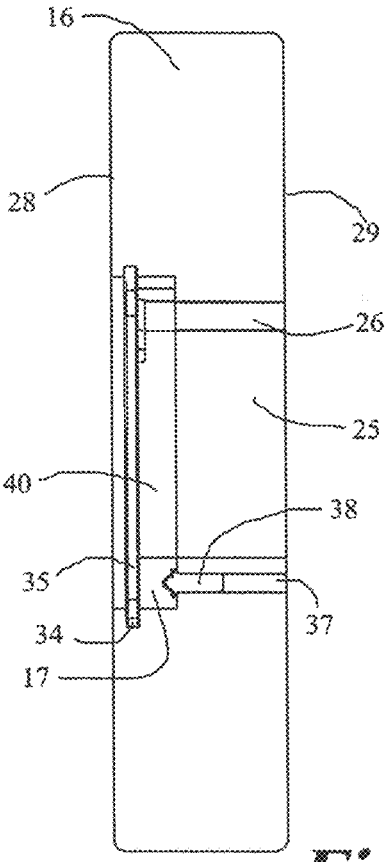
FIG. 6 is a sectional view of FIG. 5 taken along line 6-6.

Referring to FIGS. 5 and 7, the inner and outer faces 43 and 44 of the ring 17 shown each have a relieved area 47 with a selected depth. The relieved areas 47 extend from opposite sides of the ring keyway 41, such that each relieved area 47 appears to extend counter-clockwise from the ring keyway 41. The ring 17 is sized to fit into the channels 23 in the projecting portion 21 of the key 15 at the relieved areas 47 while the remainder of the ring 17 is thicker than the channels 23 in the projecting portion 21 of the key 15. The relieved areas 47 provide an offset, equal to the depth of the relieved areas 47, in the adjustment of the roller 16, depending on the direction of rotation of the ring 17 relative to the roller 16 when the roller 16 is locked on the shaft 14.

Although the present invention has been described with a certain degree of particularity, it is understood that the present disclosure has been made by way of example and that changes in details of structure may be made without departing from the spirit thereof.

What is claimed is:

1. A forming roller adjustment system comprising:

a shaft having an axially extending shaft keyway, a key sized to fit into and mounted in said keyway, and having a projecting portion that projects outwardly from said shaft, said projecting portion including a plurality of spaced, transverse channels, a roller having a roller shaft aperture sized to receive said shaft, and a roller keyway that projects outwardly from said roller shaft aperture and is sized to receive said projecting portion of said key, and a ring rotatably attached to said roller and sized to fit into said channels in said projecting portion of said key, said ring having a ring shaft aperture sized to receive said shaft, and a ring keyway that projects outwardly from said ring shaft aperture and is sized to receive said projecting portion of said key, whereby when said ring is rotated to align said ring keyway with said roller keyway, said roller is axially movable along said shaft, and when said ring is aligned with one of said channels in said projecting portion of said key and rotated into said channel such that said ring keyway is not aligned with said roller keyway, said roller is axially locked on said shaft.

2. The system as set forth in claim 1 wherein:

said roller has a first face and a spaced, oppositely facing second face and includes a cylindrical ring recess defined by a cylindrical face that extends inwardly from said first face connected to a radial face that extends radially outwardly from said roller shaft aperture to beyond said roller keyway, and said ring is sized to fit into said ring recess.

3. The system as set forth in claim 2 wherein:

said roller has a radially outwardly extending circlip groove that extends circumferentially around said cylindrical face near said first face and a circlip that fits into said circlip groove, and said ring is sized to fit into said ring recess between said radial face and said circlip.

4. The system as set forth in claim 2 wherein:

said roller has a detent aperture that extends through said roller from said radial face and a ball detent that fits into said detent aperture from said radial face, and said ring has an inner face, that faces said radial face of said ring recess, and a spaced outer face, said inner face including a circumferentially extending recessed portion, with said recessed portion having three circumferentially spaced detents, said detents being sized and positioned to receive said ball detent to hold said ring relative to said roller when one of: said ring keyway is aligned with said roller keyway, said ring keyway is moved counter-clockwise relative to said roller keyway and said ring keyway is moved clockwise relative to said roller keyway.

5. The system as set forth in claim 2 wherein said ring has an inner face, that faces said radial face of said ring recess, and a spaced outer face, said inner and outer faces of said ring each having a relieved area with a selected depth, said relieved areas extending from opposite sides of said ring keyway, said ring being sized to fit into said channels in said projecting portion of said key at said relieved areas while said ring is thicker than said channels in said projecting portion of said key beyond said relieved areas.

6. The system as set forth in claim 1 wherein said key is attached to said shaft by mechanical fasteners.

7. A forming roller adjustment system comprising:

a shaft having an axially extending shaft keyway, a key sized to fit into and mounted in said keyway, and having a projecting portion that projects outwardly from said shaft, said projecting portion including a plurality of spaced, transverse channels, a roller having a roller shaft aperture sized to receive said shaft, and a roller keyway that projects outwardly from said roller shaft aperture and sized to receive said projecting portion of said key, said roller having a first face and a spaced, oppositely facing second face and including a cylindrical ring recess defined by a cylindrical face that extends inwardly from said first face connected to a radial face that extends radially outwardly from said roller shaft aperture to beyond said roller keyway, said roller having a radially outwardly extending circlip groove that extends circumferentially around said cylindrical face near said first face and a circlip that fits into said circlip groove, said roller having a detent aperture that extends through said roller from said radial face and a ball detent that fits into said detent aperture from said radial face, and a ring sized to fit into and rotate in said ring recess between said radial face and said circlip, said ring having a ring shaft aperture sized to receive said shaft and a ring keyway that projects outwardly from said ring shaft aperture, said ring having an inner face, that faces said radial face of said ring recess, and a spaced outer face, said inner face including a circumferentially extending recessed portion, with said recessed portion having three circumferentially spaced detents, said detents being sized and positioned to receive said ball detent to hold said ring relative to said roller when one of: said ring keyway is aligned with said roller keyway, said ring keyway is moved counter-clockwise relative to said roller keyway and said ring keyway is moved clockwise relative to said roller keyway, said inner and outer faces of said ring each having a relieved area with a selected depth, with said relieved areas extending from opposite sides of said ring keyway, said ring being sized to fit into said channels in said projecting portion of said key at said relieved areas while said ring is thicker than said channels in said projecting portion of said key beyond said relieved areas, whereby when said ring is rotated to align said ring keyway with said roller keyway, said roller is axially movable along said shaft, and when said ring is aligned with one of said channels in said projecting portion of said key and rotated into said channel such that said ring keyway is not aligned with said roller keyway, said roller is axially locked on said shaft.

* * * * *